US010272401B2

(12) United States Patent
Lee et al.

(10) Patent No.: US 10,272,401 B2
(45) Date of Patent: Apr. 30, 2019

(54) NON-ELECTRIC PORTABLE BLOOD TUBE MIXER

(71) Applicant: Mo Siu Mei Lee, Taipei (TW)

(72) Inventors: Mo Siu Mei Lee, Taipei (TW); Shey-Ying Chen, Taipei (TW); Tzu-I Chien, Taipei (TW); Bey-Jing Yang, Taipei (TW); Pin-Fei Wei, Taipei (TW); Shau-Han Wu, Taipei (TW); Yung-Chen Yao, Taipei (TW); Cheng-Chung Fang, Taipei (TW)

(73) Assignee: Mo Siu Mei Lee, Taipei (TW)

( * ) Notice: Subject to any disclaimer, the term of this patent is extended or adjusted under 35 U.S.C. 154(b) by 63 days.

(21) Appl. No.: 15/492,682

(22) Filed: Apr. 20, 2017

(65) Prior Publication Data

US 2018/0304213 A1 Oct. 25, 2018

(51) Int. Cl.
*B01F 9/00* (2006.01)

(52) U.S. Cl.
CPC ..... *B01F 9/0014* (2013.01)

(58) Field of Classification Search
CPC ..... B01F 9/0014; B01F 2215/0034; B01F 9/0034; B65D 5/16
See application file for complete search history.

(56) References Cited

U.S. PATENT DOCUMENTS 3,191,818 A * 6/1965 Farquhar ..... B65D 5/722 222/457
6,253,930 B1 * 7/2001 Freidus ..... A47F 5/112 211/59.2

* cited by examiner

*Primary Examiner* — Anshu Bhatia
(74) *Attorney, Agent, or Firm* — Muncy, Geissler, Olds & Lowe, P.C.

(57) ABSTRACT

The present invention is to provide a non-electric portable blood tube mixer comprising a frame and a slide. The frame includes an entry opening at a relatively high position of the frame and an outlet opening at a relatively low position of the frame. The slide is provided in the frame and includes an inclined-plate assembly consisting of plated that are vertically spaced from one another and are arranged in a zigzag manner, and the slide has two ends that are respectively connected to the entry opening and the outlet opening, thus allowing the tube to roll along the slide from a relatively high position of the frame to a relatively low position of the frame.

8 Claims, 7 Drawing Sheets

NON-ELECTRIC PORTABLE BLOOD TUBE MIXER

BACKGROUND OF THE INVENTION

1. Technical Field

The present invention relates to a blood tube mixer and more particularly to a non-electric portable blood tube mixer that eliminates the need to shake blood samples manually.

2. Description of Related Art

A physician wishing to know a patient's health condition may, if necessary, order a blood test in addition to making inquiries and visual observations. The test results of a blood sample may include such data as the degree of inflammation, the degree of anemia, the effectiveness of blood coagulation, and variation in blood cell distribution, each item of which may serve as a basis on which to diagnose the type of disease the patient is suffering from.

Due to the coagulation function of the platelets, or thrombocytes, in blood, failure to mix a blood sample with an anticoagulant as soon as possible may lead to blood coagulation and have adverse effect on the subsequent tests, thus hindering diagnosis or even delaying treatment. In order to mix a blood sample with an anticoagulant in a timely and sufficient manner, it is required that blood samples be shaken immediately after they are taken.

However, the action by which or the time for which a blood-loaded test tube is manually shaken tends to vary with the circumstances (e.g., a great number of patients need to be attended to, or the blood sample in question is taken in an emergent condition), so the shaking operation does not ensure that each blood sample is thoroughly mixed with an anticoagulant. Should a blood sample coagulate, not only will the intended blood test be prevented, but also the patient has to undergo the blood drawing procedure again, which adds to the burden on the patient's body as well as the phlebotomist' work load and psychological stress in anticipation of patient complaints. A coagulated blood sample results in a wasteful use of medical resources, if not retarding treatment that may otherwise start sooner.

In view of the fact that failure to mix a blood sample with an anticoagulant at the earliest possible time may cause premature coagulation, making it impossible to perform subsequent tests, the inventor of the present invention believes that further optimization of the conventional blood sampling method is called for to reduce patients' and phlebotomists' burden, to accelerate the making and interpretation of blood test reports, to prepone the timing of treatment, and to better the quality of medical services in general.

SUMMARY OF THE INVENTION

The primary objective of the present invention is to overcome the aforesaid drawback of the conventional blood sampling method, namely the inability to prevent blood coagulation such that test results may be compromised and the quality of medical services, lowered.

To overcome the foresaid problem, the present invention is to provide a non-electric portable blood tube mixer, comprising a frame and a slide. The frame includes an entry opening at a relatively high position of the frame and an outlet opening at a relatively low position of the frame. The slide is provided in the frame and includes an inclined-plate assembly consisting of plated that are vertically spaced from one another and are arranged in a zigzag manner, and the slide has two ends that are respectively connected to the entry opening and the outlet opening, thus allowing the tube to roll along the slide from a relatively high position of the frame to a relatively low position of the frame.

Further, the inclined-plate assembly includes a first guide plate provided on one side of the entry opening, a second guide plate provided on one side of the outlet opening, and one or a plurality of intermediate guide plates provided between the first guide plate and the second guide plate.

Further, the first guide plate is provided with a projecting portion to prevent the tube from spinning on the inclined surface of the first guide plate, and the projecting portion includes a first inclined side for preventing rotation of the tube and a second inclined side for increasing the rolling speed of the tube.

Further, an edge portion of the uppermost intermediate guide plate that faces the first guide plate is provided with a trapezoidal stopper, and the trapezoidal stopper includes a front stopper plate provided along the edge portion of the intermediate guide plate and two lateral stopper plates provided respectively on two lateral sides of the front stopper plate, wherein each lateral stopper plate forms an obtuse included angle with the front stopper plate.

Further, the entry opening includes a tapered funnel which has a slope and a channel which is in communication with the tapered funnel and connected to the slide, and the tapered funnel is larger than the channel so that the tube can be put into the tapered funnel with ease.

Further, the interior space of the channel extends horizontally with rolling direction of the tube.

Further, the inclined-plate assembly is mounted to the frame by a detachable means.

Further, the frame includes a plurality of side plates, and the corresponding side plates are connected together via a pivotal connection means in order to rotate with respect to each other.

Further, the pivotal connection means includes corresponding pivot holes provided respectively at the connected portions of each pair of the corresponding side plates, and torsion springs, gears, or linkages provided respectively at each pair of corresponding pivot holes.

Further, the frame is fixed on top of or under a tablet computer table, or on top of or under shelf of a medical cart by a locking means.

Therefore, comparing to the prior art, the present invention has advantages described as below:

1. The present invention provides a slide on which a tube can roll from a high position to a low position, and which therefore eliminates the need to shake the tube manually. The slide simplifies manual operation, ensures sufficient agitation of the sample in the tube, reduces the chance of resampling, and thus contributes to raising the quality of medical services.

2. The present invention provides a guide plate with a projecting portion to prevent a tube from spinning on the inclined surface of the guide plate. The projecting portion further allows the tube to keep rolling down the inclined surface and be agitated as intended.

3. The inclined guide plates in the present invention are detachable and therefore can be easily cleaned and sterilized to maintain the quality of medical services.

4. The folding frame in the present invention provides an additional storage function to facilitate the storage of medical supplies.

BRIEF DESCRIPTION OF THE DRAWINGS

FIG. 5-1 shows an operating diagram of one embodiment of the non-electric portable tube mixer (a).

FIG. 5-2 shows an operating diagram of one embodiment of the non-electric portable tube mixer (b).

FIG. 5-3 shows an operating diagram of one embodiment of the non-electric portable tube mixer (c).

DETAILED DESCRIPTION OF THE EMBODIMENT OF THE INVENTION

Descriptions and techniques of the present invention would be illustrated in detail with reference to the accompanying drawings herein. Furthermore, for easier illustrating, the drawings of the present invention are not a certainly the practical proportion and are not limited to the scope of the present invention.

First Embodiment

Figure 1:
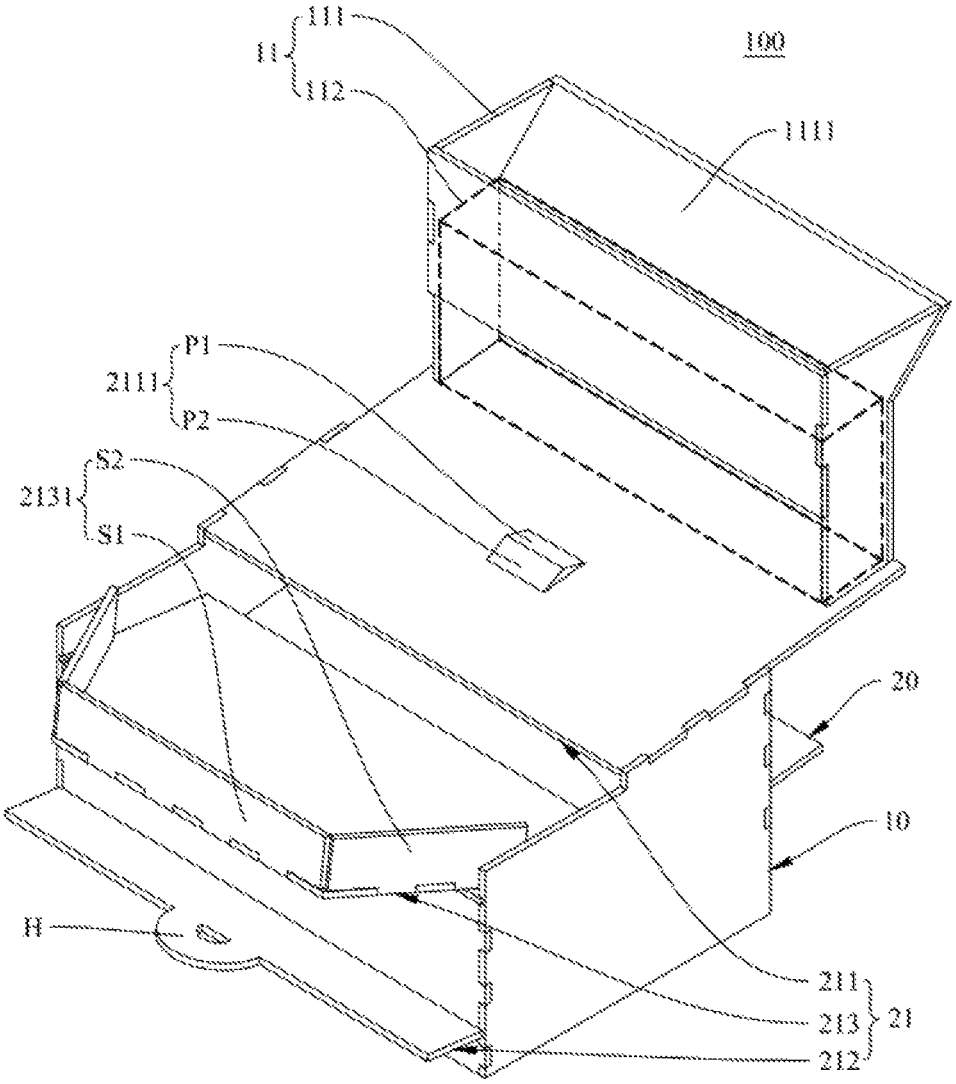
FIG. 1 shows an assembled perspective view of one embodiment of the non-electric portable tube mixer.
Figure 2:
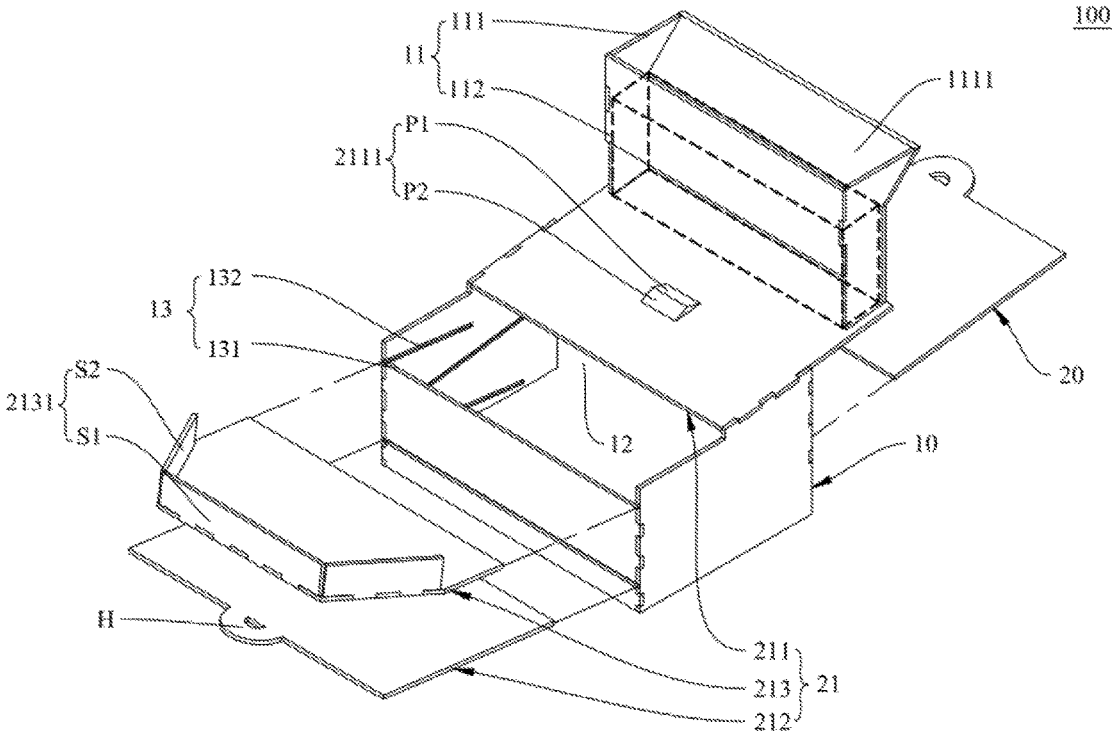
FIG. 2 shows an exploded perspective view of one embodiment of the non-electric portable tube mixer.

A preferred embodiment of the present invention is described below with reference to FIG. 1 and FIG. 2, which respectively show an assembled perspective view and an exploded perspective view of a non-electric portable blood tube mixer according to the invention.

The non-electric portable blood tube mixer 100 disclosed herein includes a frame 10 and a slide 20. The non-electric portable blood tube mixer 100 is configured mainly for medical purposes, or more specifically for agitating a blood-loaded tube M (see FIG. 5-1) and thereby mixing the blood and anticoagulant in the tube M, lest blood coagulation impede subsequent tests on the blood.

The frame 10 includes an entry opening 11 at a relatively high position of the frame 10 and an outlet opening 12 at a relatively low position of the frame 10 so that the tube M can be dropped into the entry opening 11 and then come out through the outlet opening 12. To prevent bacterial growth, the frame 10 in this preferred embodiment may be made of acrylic, plastic, wood panels, polypropylene (PP), polycarbonate (PC), or other materials that can be easily cleaned. The frame 10 is assembled from a plurality of plates and can be disassembled to reduce the space occupied and facilitate storage.

The frame 10 is fixed under a tablet computer table or the top shelf of a medical cart by a locking means (not shown). The locking means may involve providing the frame 10 with hinges and fixing the frame 10 to the table or cart via threaded fasteners. Mechanisms other than hinges and capable of securing the frame 10 may also be used; the present invention has no limitation in this regard.

The entry opening 11 includes a tapered funnel 111 and a channel 112. The tapered funnel 111 has a slope 1111 while the channel 112 is in communication with the tapered funnel 111 and connected to the slide 20. The tapered funnel 111 is larger than the channel 112 and expands along the slope 1111 so that the tube M can be put into the tapered funnel 111 with ease. The interior space of the channel 112 extends horizontally, and the tube M is expected to be dropped into the entry opening 11 in generally the same horizontal orientation in order for the channel 112 to adjust the rolling direction of the tube M.

The slide 20 is provided in the frame 10 and includes an inclined-plate assembly 21 consisting of plates that are vertically spaced from one another and are arranged in a zigzag manner, as described in more detail below. The slide 20 has two ends that are respectively connected to the entry opening 11 and the outlet opening 12, thus allowing the tube M to roll along the slide 20 from a relatively high position of the frame 10 to a relatively low position of the frame 10. To prevent bacterial growth, the slide 20 in this preferred embodiment may be made of acrylic, plastic, wood panels, PP, PC, or other materials that can be easily cleaned.

The inclined-plate assembly 21 is mounted to the frame 10 by a detachable means 13. The inclined-plate assembly 21 includes a first guide plate 211 provided on one side of the entry opening 11, a second guide plate 212 provided on one side of the outlet opening 12, and one or a plurality of intermediate guide plates 213 provided between the first guide plate 211 and the second guide plate 212. The first guide plate 211, the second guide plate 212, and the intermediate guide plates 213 are not horizontal (i.e., not parallel to the ground) so that the tube M can roll downward due to gravity. In this preferred embodiment, referring to FIG. 2, the detachable means 13 includes a plurality of insertion slots 131 provided in the frame 10 and a plurality of tracks 132 each pair of which are in communication with the corresponding insertion slot 131. To put the inclined-plate assembly 21 together, the second guide plate 212 and the intermediate guide plates 213 are inserted through the insertion slots 131 into the corresponding pairs of tracks 132 respectively. To disassemble, the second guide plate 212 and the intermediate guide plates 213 are pulled out from outside the frame 10. In another preferred embodiment, the second guide plate 212 and the intermediate guide plates 213 are each provided with a handle H lying outside the frame 10 to facilitate gripping and force application by an operator.

The first guide plate 211 is provided with a projecting portion 2111 to prevent the tube M from spinning on the inclined surface of the first guide plate 211. The projecting portion 2111 includes a first inclined side P1 for preventing rotation of the tube M and a second inclined side P2 for increasing the rolling speed of the tube M. While rolling, the tube M tends to turn sideways, rather than move linearly, because the diameter of the lid of the tube M is typically larger than the outer diameter of the tube M. Should the tube M turn in such a way that it lies against a lateral edge of the first guide plate 211, further rolling will be impossible. The projecting portion 2111 is so designed that, when the lid of the tube M hits the projecting portion 2111, the angle through which the tube M will turn is reduced. This keeps the tube M from getting stuck and enables the tube M to roll further downward in order to be agitated, thereby promoting reaction between the blood and anticoagulant in the tube M and preventing blood coagulation.

An edge portion of the uppermost intermediate guide plate 213 that faces the first guide plate 211 is provided with a trapezoidal stopper 2131. The trapezoidal stopper 2131 includes a front stopper plate S1 provided along the edge portion of the intermediate guide plate 213 and two lateral stopper plates S2 provided respectively on two lateral sides of the front stopper plate S1, wherein each lateral stopper plate S2 forms an obtuse included angle with the front stopper plate S1. The trapezoidal stopper 2131 limits the angle through which the tube M can turn, lest the tube M become perpendicular to the transverse direction of the intermediate guide plate 213 and thus hindered from rolling.

Second Embodiment

Another preferred embodiment of the present invention is described below with reference to FIG. 3 and FIG. 4, which respectively show two perspective views of a non-electric portable blood tube mixer according to the invention.

The non-electric portable blood tube mixer 200 disclosed herein includes a frame 30 and a slide 40. The non-electric portable blood tube mixer 200 is configured mainly for medical purposes, or more specifically for agitating a blood-loaded tube M (see FIG. 5-1) and thereby mixing the blood and anticoagulant in the tube M, lest blood coagulation impede subsequent tests on the blood.

The frame 30 includes an entry opening 31 at a relatively high position of the frame 30 and an outlet opening 32 at a relatively low position of the frame 30 so that the tube M can be dropped into the entry opening 31 and then come out through the outlet opening 32. To prevent bacterial growth, the frame 30 in this preferred embodiment may be made of acrylic, plastic, wood panels, polypropylene (PP), polycarbonate (PC), or other materials that can be easily cleaned. The frame 30 is assembled from a plurality of plates and can be disassembled to reduce the space occupied and facilitate storage.

Figure 3:
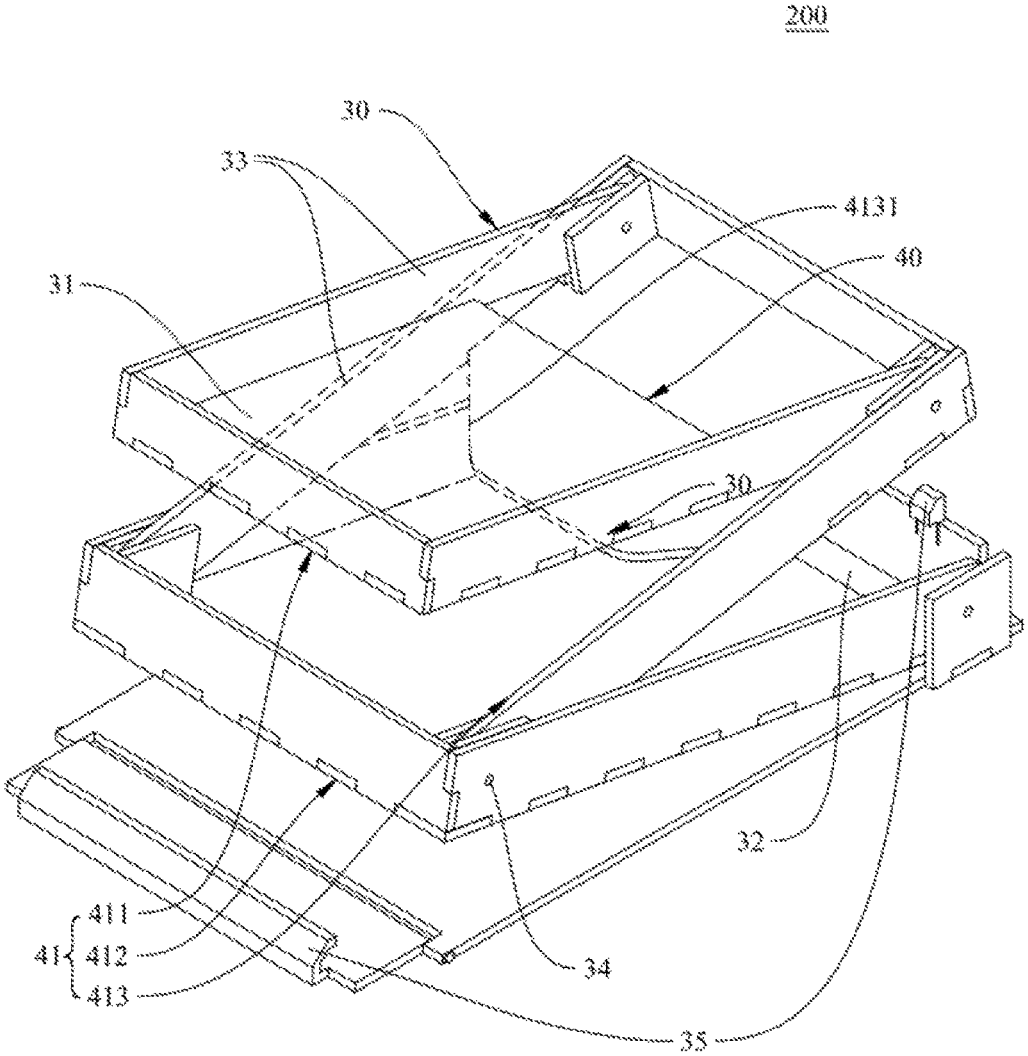
FIG. 3 shows an assembled perspective view of another embodiment of the non-electric portable tube mixer (a).
Figure 4:
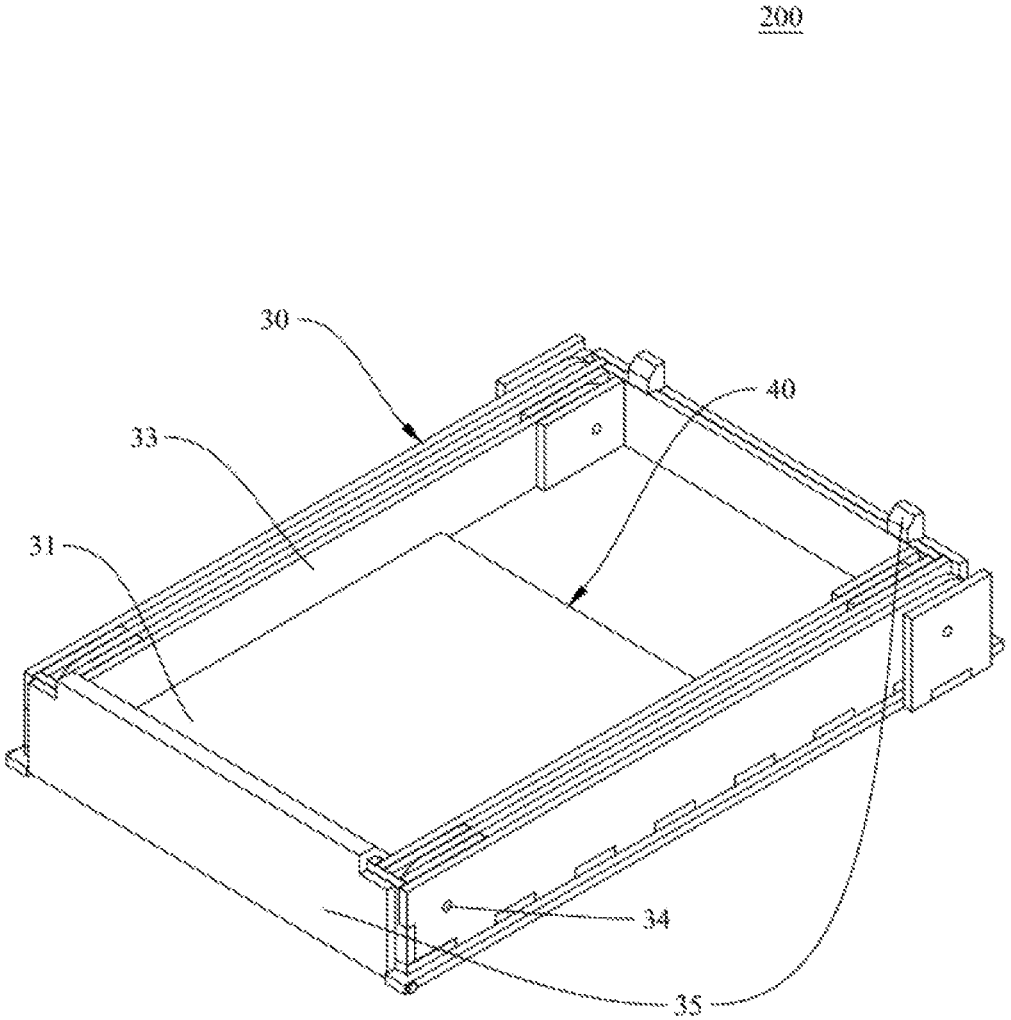
FIG. 4 shows an assembled perspective view of another embodiment of the non-electric portable tube mixer (b).

As shown in FIG. 3 and FIG. 4, the frame 30 includes a plurality of side plates 33. The corresponding side plates 33 are connected together via a pivotal connection means 34 in order to rotate with respect to each other. The pivotal connection means 34 may include corresponding pivot holes provided respectively at the connected portions of each pair of corresponding side plates 33, and torsion springs (not shown) provided respectively at each pair of corresponding pivot holes. In this preferred embodiment, as shown in FIG. 3, the frame 30 can unfold in response to the action of torsion springs, thus forming the slide 40, on which the tube M can roll. Moreover, as shown in FIG. 4, the slide 40 can be brought into an overlapping configuration by pressing down on the frame 30 and be clamped in place by clasps 35 provided respectively on two opposite sides of the bottom of the frame 30 to prevent the torsion springs from unfolding the slide 40. In the folded state as shown in FIG. 4, the non-electric portable blood tube mixer 200 can be used to store various medical supplies such as test tubes, syringes, tourniquets, and alcohol preparation pads. Aside from torsion springs, the folding/unfolding mechanism of the frame 30 may involve gears, linkages, or any other means for adjusting the angle of the frame 30 in order to fold and unfold the frame 30.

The slide 40 is provided in the frame 30 and includes an inclined-plate assembly 41 consisting of plates that are vertically spaced from one another and are arranged in a zigzag manner, as described in more detail below. The slide 40 has two ends that are respectively connected to the entry opening 31 and the outlet opening 32, thus allowing the tube M to roll along the slide 40 from a relatively high position of the frame 30 to a relatively low position of the frame 30. To prevent bacterial growth, the slide 40 in this preferred embodiment may be made of acrylic, plastic, wood panels, PP, PC, or other materials that can be easily cleaned.

The inclined-plate assembly 41 includes a first guide plate 411 provided on one side of the entry opening 31, a second guide plate 412 provided on one side of the outlet opening 32, and one or a plurality of intermediate guide plates 413 provided between the first guide plate 411 and the second guide plate 412. The tube M can roll from the relatively high first guide plate 411 to the relatively low second guide plate 412 in order to be agitated. In this preferred embodiment, the intermediate guide plate 413 is provided with a trapezoidal slope 4131 so that the tube M can keep rolling downward even when it has rolled into a corner of the intermediate guide plate 413.

Figures 1, 5:
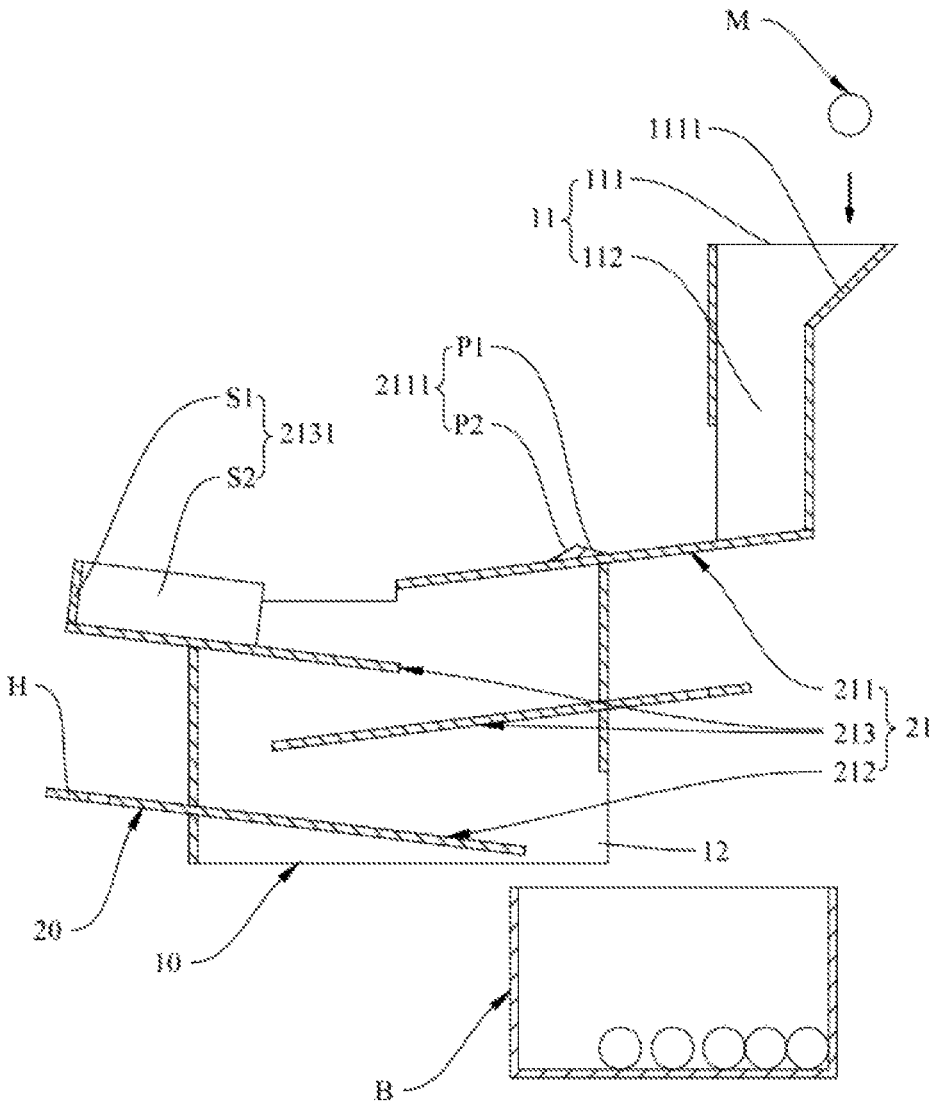
Figures 2, 5:
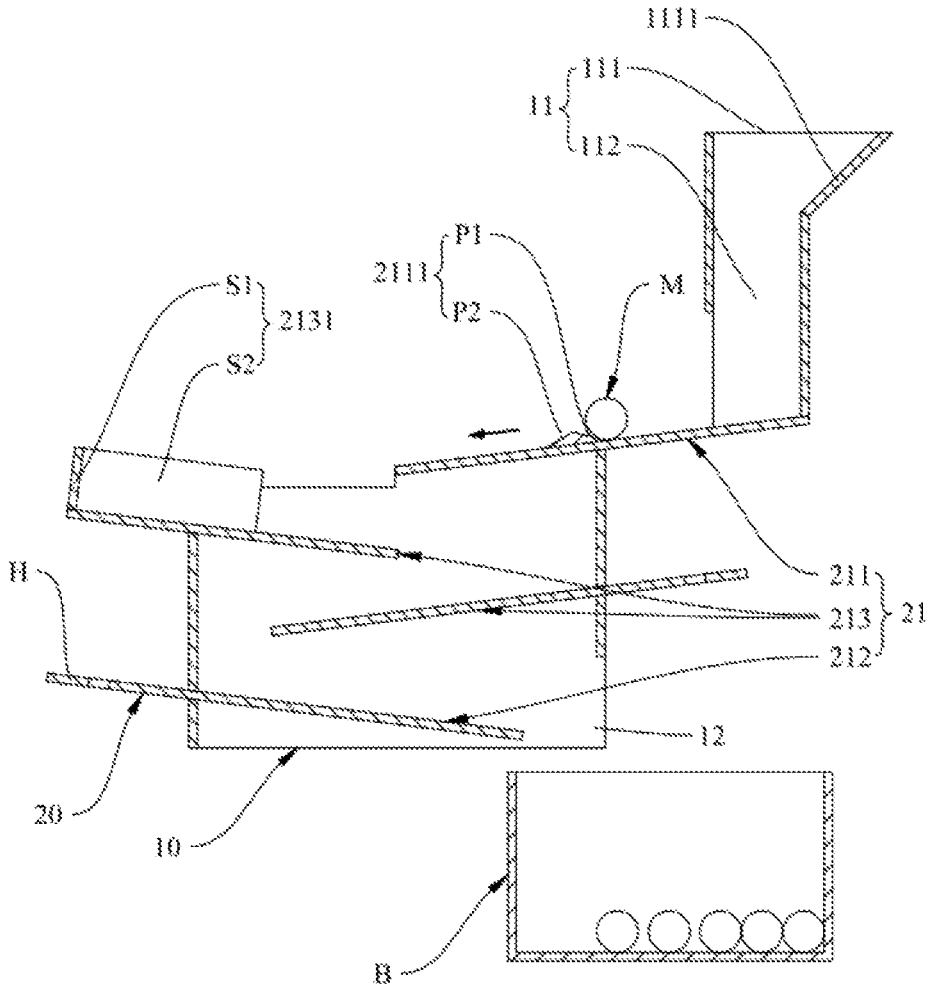
Figures 3, 5:
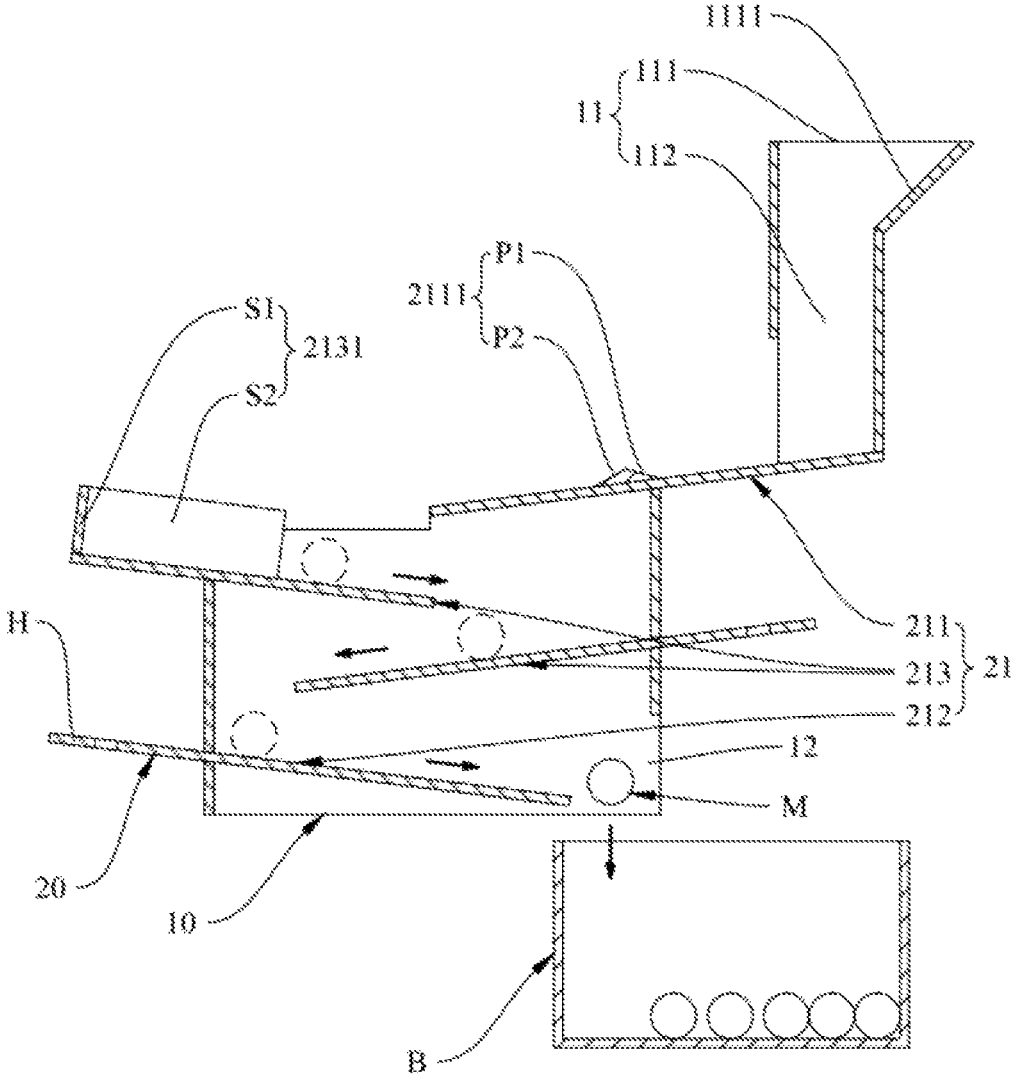

The rolling action of the tube M in the non-electric portable blood tube mixer is detailed below with reference to FIG. 5-1 to FIG. 5-3.

To start with, the tube M is dropped into the mixer from above the frame 10, with the falling speed of the tube M increased by gravity. Then, the tube M falls onto the first guide plate 211 and begins to roll. When the tube M comes into contact with the projecting portion 2111, the rolling speed of the tube M is reduced such that the tube M is agitated. The tube M keeps on rolling and is continually agitated as the guide plates in the inclined-plate assembly 21 change their inclination directions. The tube M eventually rolls out of the outlet opening 12 and is collected by a collection box B on one side of the outlet opening 12 to conclude the agitation process of the tube M.

According to the above, the slide in the present invention makes it unnecessary to shake blood tubes manually and reduces the chance of having to take more blood samples to replace the coagulated ones. Also, the present invention provides a projecting portion for agitating blood tubes, a plurality of inclined guide plates that can be detached to facilitate cleaning, and a folding frame that can double as a container. In a nutshell, the present invention provides a practical device that helps enhance the quality of medical services.

The present invention is more detailed illustrated by the above preferable example embodiments. While example embodiments have been disclosed herein, it should be understood that other variations may be possible. Such variations are not to be regarded as a departure from the spirit and scope of example embodiments of the present application, and all such modifications as would be obvious to one skilled in the art are intended to be included within the scope of the following claims.

What is claimed is:

1. A non-electric portable blood tube mixer, comprising:

a frame, including an entry opening at a relatively high position of the frame, an outlet opening at a relatively low position of the frame, and the frame includes a plurality of side plates, and the corresponding side plates are connected together via a pivotal connection means in order to rotate with respect to each other, wherein the pivotal connection means includes corresponding pivot holes provided respectively at connected portions of each pair of the corresponding side plates, and torsion springs, gears, or linkages provided respectively at each pair of corresponding pivot holes; and a slide, provided in the frame and includes an inclined-plate assembly consisting of plates that are vertically spaced from one another and are arranged in a zigzag manner, and the slide has two ends that are respectively connected to the entry opening and the outlet opening, thus allowing the tube to roll along the slide from a relatively high position of the frame to a relatively low position of the frame.

2. The non-electric portable blood tube mixer of claim 1, wherein the inclined-plate assembly includes a first guide plate provided on one side of the entry opening, a second guide plate provided on one side of the outlet opening, and one or a plurality of intermediate guide plates provided between the first guide plate and the second guide plate.

3. The non-electric portable blood tube mixer of claim 2, wherein the first guide plate is provided with a projecting portion to prevent the tube from spinning on the inclined surface of the first guide plate, and the projecting portion includes a first inclined side for preventing rotation of the tube and a second inclined side for increasing the rolling speed of the tube.

4. The non-electric portable blood tube mixer of claim 2, wherein an edge portion of the uppermost intermediate guide plate that faces the first guide plate is provided with a trapezoidal stopper, and the trapezoidal stopper includes a front stopper plate provided along the edge portion of the intermediate guide plate and two lateral stopper plates provided respectively on two lateral sides of the front stopper plate, wherein each lateral stopper plate forms an obtuse included angle with the front stopper plate.

5. The non-electric portable blood tube mixer of claim 1, wherein the entry opening includes a tapered funnel which has a slope and a channel which is in communication with the tapered funnel and connected to the slide, and the tapered funnel is larger than the channel so that the tube can be put into the tapered funnel with ease.

6. The non-electric portable blood tube mixer of claim 5, wherein the interior space of the channel extends horizontally with rolling direction of the tube.

7. The non-electric portable blood tube mixer of claim 1, wherein the inclined-plate assembly is mounted to the frame by a detachable means, and the detachable means includes a plurality of insertion slots provided in the frame and a plurality of tracks, each pair of which are in communication with the corresponding insertion slot.

8. The non-electric portable blood tube mixer of claim 1, wherein the frame is fixed on top of or under a tablet computer table, or on top of or under a shelf of a medical cart by a locking means, and the locking means includes providing the frame with a hinge and fixing the frame via a threaded fastener.

* * * * *